US005836537A

United States Patent [19]

Glass

[11] Patent Number: 5,836,537

[45] Date of Patent: Nov. 17, 1998

[54] MEDICAL CORD CONTROL AND STORAGE APPARATUS

[76] Inventor: Bruce A. Glass, 74 Eastwood Dr., Deerfield, Ill. 60015

[21] Appl. No.: 888,032

[22] Filed: Jul. 3, 1997

[51] Int. Cl.[6] ..... B65H 75/44

[52] U.S. Cl. ..... 242/400.1

[58] Field of Search ..... 242/129, 398, 242/400, 400.1, 406, 407

[56] References Cited

U.S. PATENT DOCUMENTS

| | | | |
|---|---|---|---|
| 2,438,143 | 3/1948 | Brown | 242/406 |
| 3,395,308 | 7/1968 | Meyer | 242/129 |
| 3,752,148 | 8/1973 | Schmalzbach . | |
| 4,062,430 | 12/1977 | Momberg | 242/400 |
| 4,498,693 | 2/1985 | Schindele | 285/137 R |
| 4,720,768 | 1/1988 | Schindele | 361/334 |
| 4,724,844 | 2/1988 | Rafelson | 312/111 |
| 4,809,393 | 3/1989 | Goodrich et al. | 242/400.1 |
| 5,513,643 | 5/1996 | Suite . | |
| 5,513,816 | 5/1996 | Grubb | 242/398 |
| 5,588,444 | 12/1996 | Petragallo . | |

*Primary Examiner*—John P. Darling

[57] ABSTRACT

An apparatus for conveniently storing and retrieving leads associated with a patient monitor in a medical room. The apparatus comprises a rectangular plate having opposed top and bottom edges and opposed left and right edges. For each of the monitor leads a pair of spaced-apart, opposed hooks is mounted on the plate near opposed edges, with each of the hooks comprising a stem having a first end in contact with the plate and a second, opposite end and a longitudinal axis. An arm extends perpendicularly outwardly from the stem second end. At least one of each pair of hooks also has a means for allowing rotation of the stem and arm about the longitudinal axis. Accordingly, each of the cords can be wrapped around a pair of hooks for storage when the arms are facing away from each other and the cords can removed from storage by rotating the at least one hook so the arm faces toward the other of the pair.

11 Claims, 5 Drawing Sheets

42
46
38
40
27
38
40
42
44
26
28

10
20
11d
52
60
42
38
54
56
38
38
30
27
11b
38
38
11a
38
38
11c 26
28
10
27
11d
38
38
38
30
11a
40
38
38
38
11b
42
11c
38
38
38

11c
11a 26
5
32
34
30
34
32
34
34
32
34
11b
5
11d 26
62
42
37
50
52
36
48
64
60
56
35
34
39
44
63
40
46
58
54
27

32
37
39
35
36
34
28
L 12
18
19
14
11a
56
38
54
10
26
30
11c
11d
14
14
38
11b
16

MEDICAL CORD CONTROL AND STORAGE APPARATUS

BACKGROUND OF THE INVENTION

This invention relates to a medical cord management apparatus, and more particularly to medical monitor lead management for the multitude of wires or cords emanating from medical monitors. The purpose of the cord management apparatus is to provide an organized, tangle free, easily accessible storage system for the multitude of monitor leads, tubes, wires and hoses required at various times for medical monitoring purposes.

Medical facilities, particularly monitored acute care areas such as ICU, emergency and recovery, have undergone an explosion in monitoring technology. In the past a patient may have had one or two monitor leads attached. Now it is not uncommon for there to be at least four and as many as eight or nine leads attached to a patient. Sensors attached to these leads monitor several functions such as skin temperature, ECG/respiration rate, non-invasive blood pressure, internal blood pressure, oxygen saturation and CO2 levels.

A problem has arisen in management of these wires when they are not in use and are left attached and dangling from the monitor in an unkempt tangled mess generally referred to in the industry as the "Spaghetti Syndrome". Removing or disengaging the cords from the monitor when not in use has not proven to be a feasible method for storage and management for a number of reasons, not the least of which is that the sensor attached to the cord is not immediately available in an emergency situation.

In addition, cords stored in a drawer become tangled and lost and are not immediately identifiable. If the cords are left dangling from the monitor, the medical room achieves an unkempt, unprofessional appearance, and again, the cords are unavailable for immediate use because individual cords are indistinguishable.

Medical room rail or headwall systems having basic storage means are known. For example, in U.S. Pat. 4,498,693, a rail system for the wall of a medical room is shown. The rail system has a mounting clamp carrying a hanger arm so that medical equipment may be positioned, retained and/or stored thereon. The arm is a simple, cantilever extension of the rail reminiscent of a shelf bracket.

U.S. Pat. 4,720,768 also discloses an electrical medical rail system. This system also discloses a dressing tray attached thereto and depending therefrom. The dressing tray is a simple box structure with a substantially open front side.

Accordingly, there has arisen a need for an efficient and easily used system or apparatus for temporarily storing and managing the numerous cords associated with medical monitoring.

SUMMARY OF THE INVENTION

In a medical room having a headwall system or a bracket for mounting a monitor, a medical cord storage apparatus comprises a plate having opposed top and bottom sides and opposed right and left sides, and means for attaching the plate to the headwall system or bracket. The cord storage system also comprises at least one pair of opposed hooks, with one of the pair adjacent the top or left side and the other adjacent the bottom or right side. Each of the hooks includes a stem having a longitudinal center line, a proximal end contacting the plate and an opposite distal end, and an arm extending at a right angle to the stem at the distal end. At least one of the pair of hooks also comprises means for allowing the stem and arm to rotate about the longitudinal center line so a cord can be wound about the opposed pair of hooks when the arm faces away from the opposite hook and the cord can be removed by rotating the hook toward the opposite hook.

In one embodiment the cord storage apparatus also comprises a means for locking the one hook in a position in which the arm is pointed away from the other of the pair of hooks.

In one embodiment of the cord storage apparatus, the means for locking the arm and the means for allowing the stem and arm to rotate comprises at least one protrusion extending outwardly from the proximal end of the stem, at least one indentation on the surface of the plate, means for urging the protrusion into the indentation when the protrusion is registered with the indentation and means for limiting the travel of the stem in the longitudinal direction if the stem is pulled away from the plate and rotated.

In another embodiment of the cord storage apparatus, the means for locking the arm and the means for allowing the stem to rotate further comprises a hollow post having a first end, a second end and a length, with the post being internally threaded. The first end of the post is secured to the plate. The underside of the head of a threaded screw contacts the second end of the post when the screw is secure. The stem has a first internal bore extending inwardly from the proximal end with a length shorter than the length of the post, a second internal bore extending inwardly from the distal end having a larger diameter than the first internal bore, and a shoulder between the first and second bores. A wave spring is located between the screw head and the shoulder for urging the stem toward the plate.

In a further embodiment of the cord storage apparatus, the plate has a first front side and a second back side and the hooks are mounted on the first side and the attaching means is mounted on the second side of the plate.

In another embodiment, the cord storage apparatus further comprises a Velcro brand hook and loop fastener strip attached to the backside for storing a blood pressure cuff also having a complementary Velcro strip.

For use in a medical room having a patient monitor and multiple patient monitor leads, a new and novel apparatus is provided for storing the leads. The apparatus comprises a plate having opposed top and bottom or left and right sides. For each of the monitor leads, a pair of spaced-apart, opposed hooks is mounted on the plate adjacent the top and bottom or left and right edges. Each of the hooks comprises a stem having a first end in contact with the plate, a second, opposite end and a longitudinal axis. An arm extends perpendicularly outwardly from the stem second end. For at least one of each pair of hooks, a means allows rotation of the stem, and accordingly the arm, about the longitudinal axis. Accordingly, each of the cords can be wrapped around the pair of hooks for storage when its arm is facing away from the other of the pair, and the cord can be removed from storage by rotating the at least one hook so the arm faces toward the other of the pair.

It is an object of the invention to provide an apparatus for temporarily storing medical monitor cords in a manner in which they can be easily stored and retrieved by the attending medical staff.

It is the further object of the invention to reduce the clutter in a medical room by allowing the medical staff to easily store medical cords on a planer board around opposed pair of hooks, and easily remove the cords from storage by simply rotating a hook.

BRIEF DESCRIPTION OF THE DRAWINGS

The invention, together with further aspects, objects, features and advantages thereof will be more clearly understood from the following description taken in conjunction with the accompanying drawings in which the elements bear the same reference numerals throughout the various views.

DESCRIPTION OF THE PREFERRED EMBODIMENTS

Figure 2:
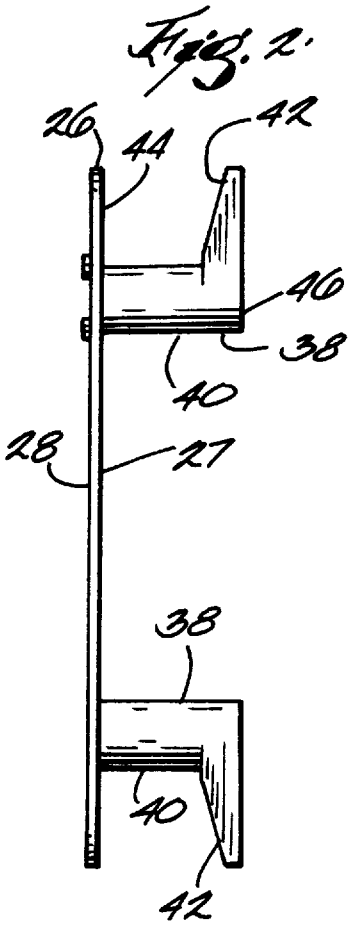
FIG. 2 is a left side elevational view of the invention.
Figure 1:
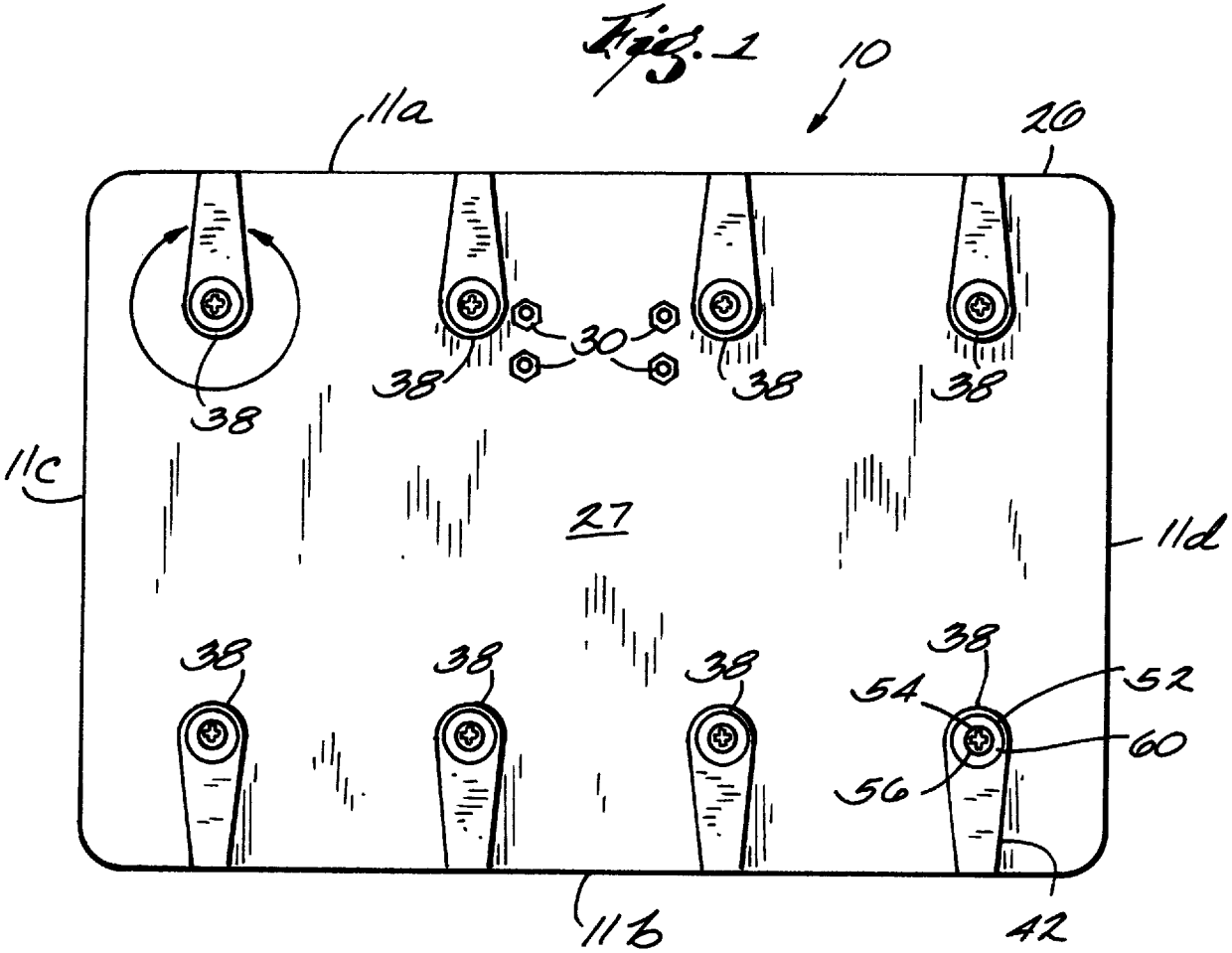
FIG. 1 is a front elevational view of the invention.
Figure 3:
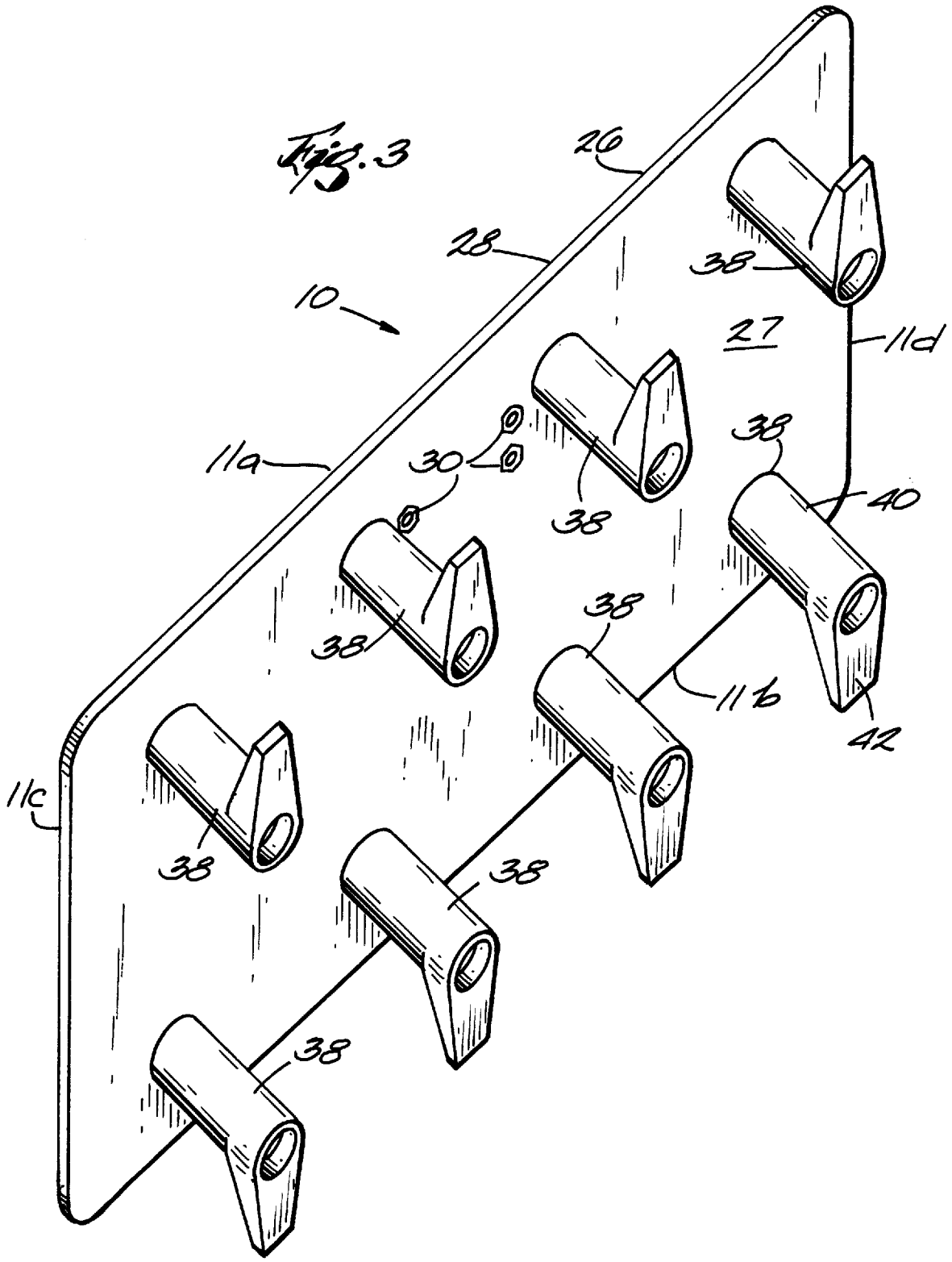
FIG. 3 Is a perspective view of the invention.
Figure 4:
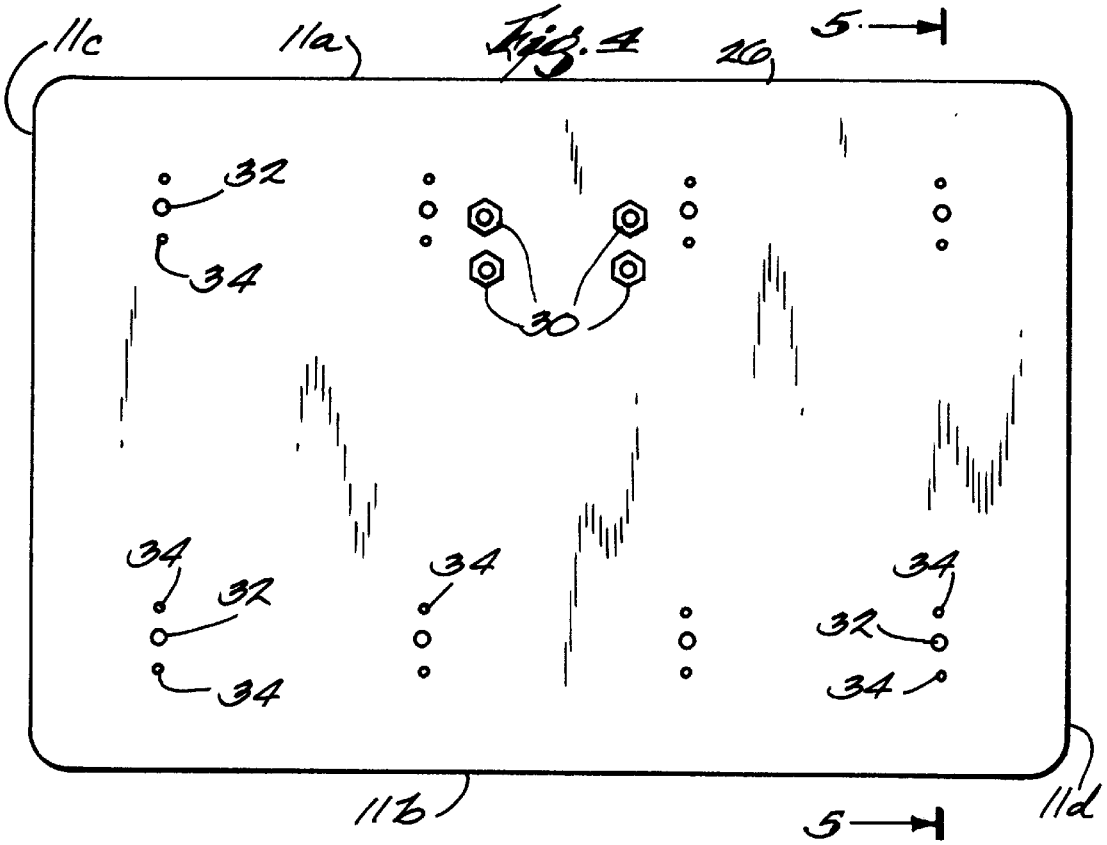
FIG. 4 is a front elevational view of the invention at one stage of manufacture.
Figure 6:
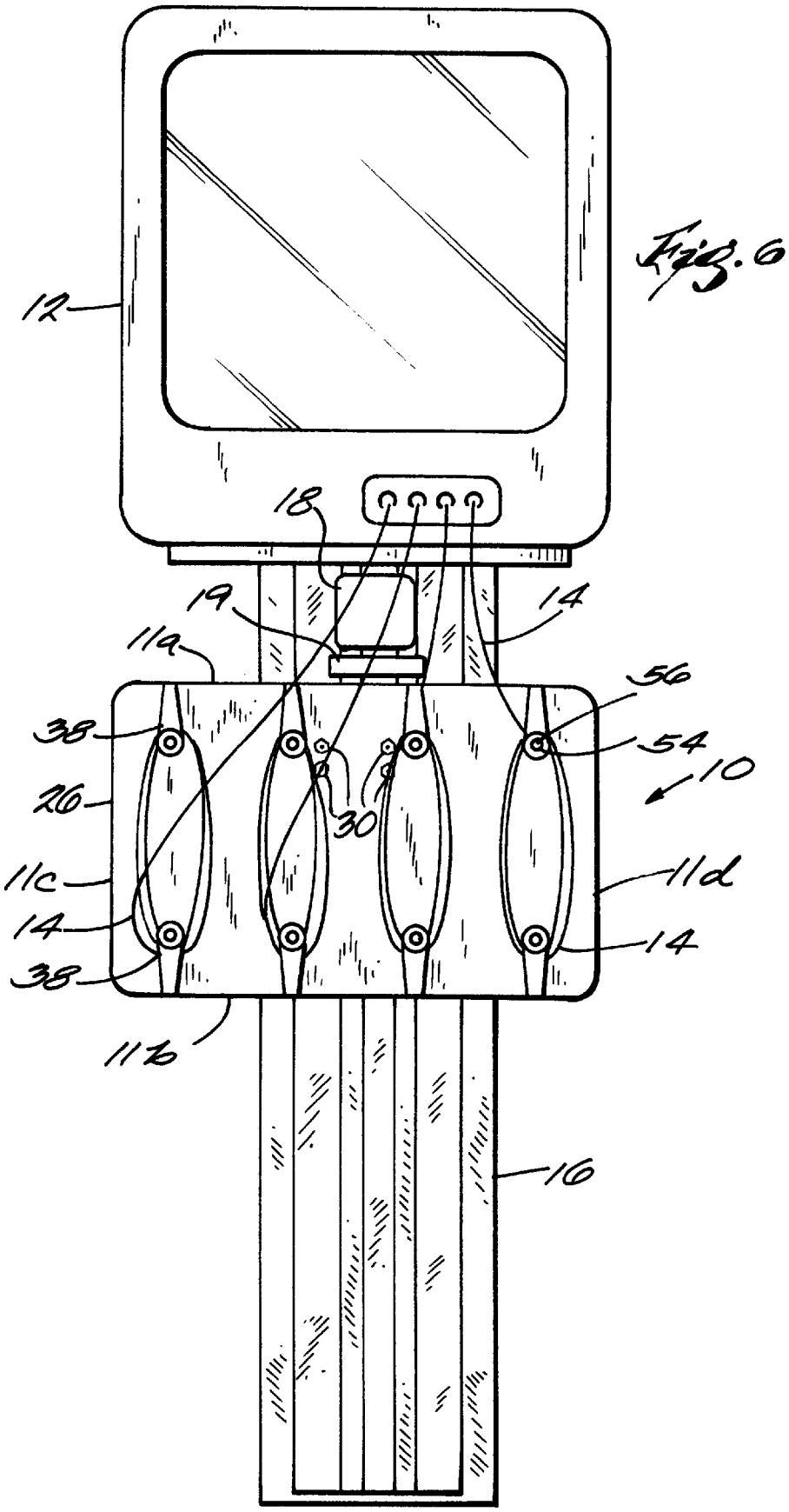
FIG. 6 is a front elevational view of the medical cord control and storage apparatus mounted below a medical monitor.

Referring generally to FIGS. 1, 3 and 6, a means or apparatus 10 is provided for efficiently and effectively managing, controlling and storing multiple medical monitor cords or leads. As explained earlier, for each patient in a medical or hospital room, a medical monitor 12 is associated. The monitor 12 provides visual and sometimes audible displays of various bodily functions such as skin temperature, ECG/respiration rate, non-invasive blood pressure, internal blood pressure, oxygen saturation and CO2 levels. Generally, pick-ups or sensors for each of these functions has its own separate cord or lead 14.

As used herein, the words leads and cords are interchangeable and can comprise tubes, wires or hoses. Leads or cords 14 generally run from an information gathering sensor associated with a body function to an information display such as a monitor. Other cords or leads 14 may also be present in a medical room, such as those for providing power to various instruments and providing necessary gases, such as oxygen, medical air and vacuum (suction).

Figure 7:
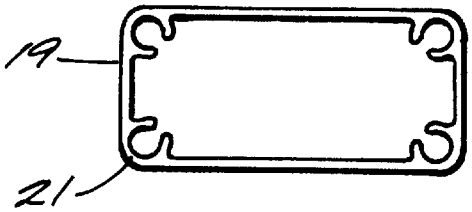
FIG. 7 is a cross sectional view of a mounting bracket for the medical cord control and storage apparatus.

The monitors 12 are generally mounted to the walls of medical rooms by means of a commercially available monitor mounting channel 16, for example those made by GCX Corporation of Petaluma, Calif. The channel can either be mounted to a wall or mounted to a modular prefabricated headwall or rail system such as those shown in U.S. Pat. Nos. 4,498,693 and 4,720,768. The monitor 12 extends in front of the channel 16 by means of a bracket 18, such as a bracket also made by GCX Corp. The cord storage or control system 10 can then be hung from the bracket 18 by a bent aluminum bar or bracket 19 or it can be engaged into the channel 16 by means of a bracket 19. The plate 26 can be vertically oriented immediately below the monitor as shown in FIG. 6. However, the plate can be rotated into various orientations in order to make its use easier by the attending medical staff. Known brackets can accommodate these various orientations. One bracket shape that has been found to be effective is shown in FIG. 7. The four generally circular channels 21 at the corners of the inside of the aluminum extrusion of the bracket can accept self-tapping screws. Alternatively, the cord storage means 10 may be mounted directly to the wall of the medical or hospital room.

The cord storage or control system 10 generally comprises a plate 26, or other flat structural sheet for mounting multiple sets of pairs of opposed hooks 38.

In a preferred embodiment, the plate 26 is rectangular, approximately twelve inches by ten inches. Each pair of opposed hooks 38 is approximately five inches apart so that approximately ten turns of cord are wound on each pair of hooks of a typical ten foot long cord or lead. The plate has opposed top 11*a* and bottom 11*b* edges and opposed left 11*c* and right 11*d* edges, with the opposed pairs of hooks 38 adjacent opposed edges.

In a preferred embodiment, the plate 26 is made of aluminum and is approximately 3/32 (0.093) inches thick. The plate comprises a first front side 27 and a second back side 28. The plate comprises four centrally located apertures 30 for attaching the mounting bracket 19 to the second side 28 of the plate 26. In a preferred embodiment, the mounting bracket 19 is attached to the second side 28 of the plate by four self tapping screws passing through the four apertures 30 located to be in registry with the recesses 21. The multiple pairs of hooks 38 are attached to the first side 27 of the plate.

Also, for each opposed hook 38, the plate has an aperture 32. Immediately beside the aperture 32 is at least one indentation, recess or dimple 34. The dimple 34 comprises an indentation on the front of the plate. In a preferred embodiment, each aperture 32 has two dimples 34 associated with it. In this embodiment, the center lines of each of the pair of opposed apertures associated with the opposed hooks and each of the four associated dimples are all collinear. Although the preferred embodiment is a dimple shape, it can be appreciated that any type of camming surface will be effective for this purpose.

In a preferred embodiment, permanently installed, as by for example welding or brazing, in each aperture is a hollow, cylindrical post 36. Alternatively, a prefabricated, internally threaded, self-clinching flush stand-off such as those made by Penn Engineering and Mfg. Corp. of Danboro, Pa. can be used. Each post 36 has a radially extending lip 35 (see FIG. 5) at its first end 37 which is attached to the plate 26 on its second, or back side 28. The post 36 extends perpendicularly outwardly from the plate first side 27 for a length L to terminate in a distal or second end 39. In a preferred embodiment, each post has an interior thread throughout its length.

Positioned over each post and rotatable thereon is a hook member 38. Each hook member is preferably made of a rigid plastic material such as 10% glass filled nylon and comprises a stem 40 and an arm 42. The stem has a proximal end 44 which, in use, contacts the first side 27 of the plate 26 and a distal end 46. Protruding radially at a right angle from the stem longitudinal axis at its distal end is an arm 42.

Figure 5:
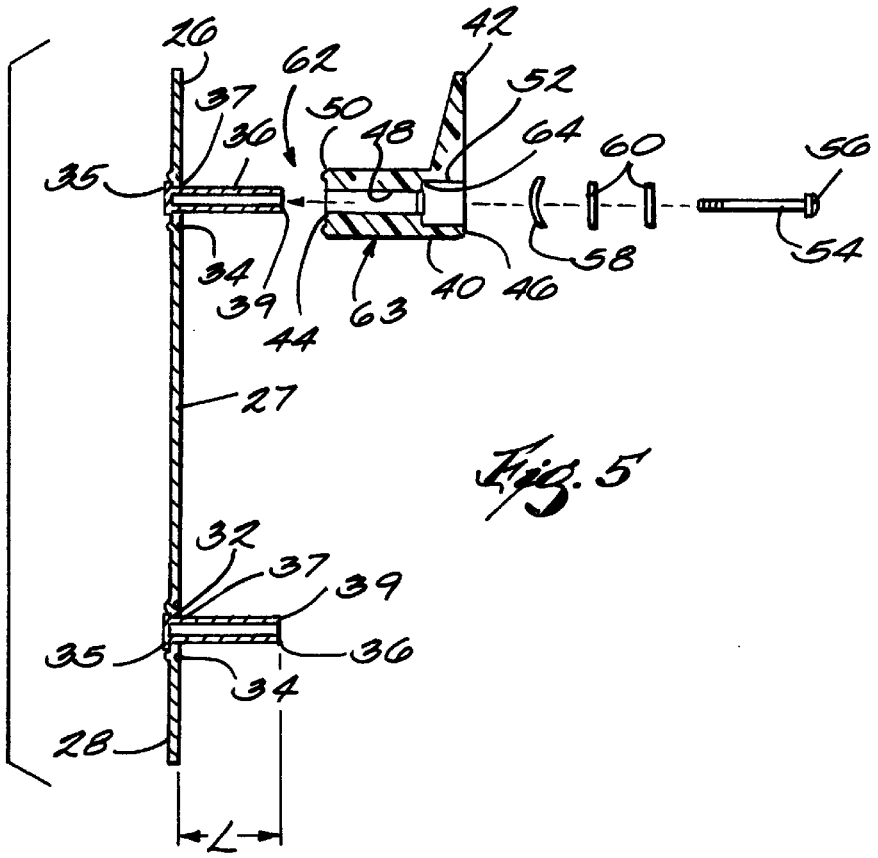
FIG. 5 is an exploded cross sectional view along line 5—5 of FIG. 4.

As shown in FIG. 5, the hook member 38 also comprises a first interior bore 48, which has an inner diameter which is slightly larger than the outer diameter of the post 36 and extends inwardly from the proximal end 44. Also at the proximal end 44 of the stem 40, is a pair of outwardly extending protrusions 50 which, in one orientation are in registry with and fit within the dimples 34. The length of the first inner bore 48, plus the length of the protrusions 50 is slightly less than the length L which the post 36 extends outwardly from the first side 27 of plate 26. Again, the protrusions 50 and dimples 34 can be any complementary camming shape.

The hook member stem 40 further comprises a second inner bore 52 extending inwardly from the distal end 46. The second inner bore 52 has an inner diameter which is larger than the outer diameter of the head 56 of the screw 54. At the intersection of the two bores is a shoulder 64.

In a preferred embodiment, each hook assembly also comprises a wave washer 58 and at least one flat washer 60 associated with the screw 54 and head 56. The wave washer 58 and flat washer 60 have an inner diameter which is larger than the shank of the screw and an outer diameter which is slightly smaller than the inner diameter of the second bore 52.

The cord storage system comprises a means 62 for locking the stem at a certain orientation and a means 63 for allowing rotation of the stem about the post. In a preferred construction, the screw 54 is screwed into the threaded interior bore of the post 36. The head of the screw contacts the free, or distal end 37 of the post 36. The one side of the wave washer 58 contacts the shoulder 64 between the first bore 48 and the second bore 52. The other side of the wave washer contacts the washer 60 which in turn contacts the underside of the head of the screw. Accordingly, the shoulder 64 is urged away from the head 56 of the screw 54 and the bottom side or proximal end 44 of the hook member 38 is urged against the first side of the plate 26. In one axial orientation, with the arm extending away from the other of the pair of apertures, the protrusions 50 extend into the dimples 34 to act as a means 62 for locking the hook in this predetermined orientation.

In operation, the means 63 for allowing rotation acts as follows. The hook can be grasped and pulled outwardly from the plate. The hook will only move the distance of the collapsibility of the wave washer, but this is sufficient for the protrusions 50 to extend out of the dimples 34. The hook member 38 can then be rotated about its longitudinal axis and the arm 42 can be pointed toward the other of the opposed pair of hooks. When the arm is pointed toward the other of the pair of hooks, the cords or leads 14 can be easily slid off the back side of the stem and removed for use. When the arm 42 is pointed away from the other of the pair of hooks, the cords or leads 14 can be wound around and onto the opposed pair of hooks for storage.

It can be appreciated that either of the opposed pair of hooks 38 can include the means for locking and the means for allowing rotation, or both could, depending on the preference of the attending staff. It can be further appreciated that it is only important for the arm 42 to rotate, not the stem 40. Accordingly, in another embodiment, the stem 40 may be fixed to the plate and have an outer end having a complementary camming surface with a rotating arm.

In one embodiment, on the second or back side 28 of the plate, can be permanently attached a Velcro brand hook and loop fastener strip. This can be especially useful for attaching a blood pressure monitor cuff which has a complementary Velcro brand hook and loop fastener strip also attached thereon.

Figure 8:
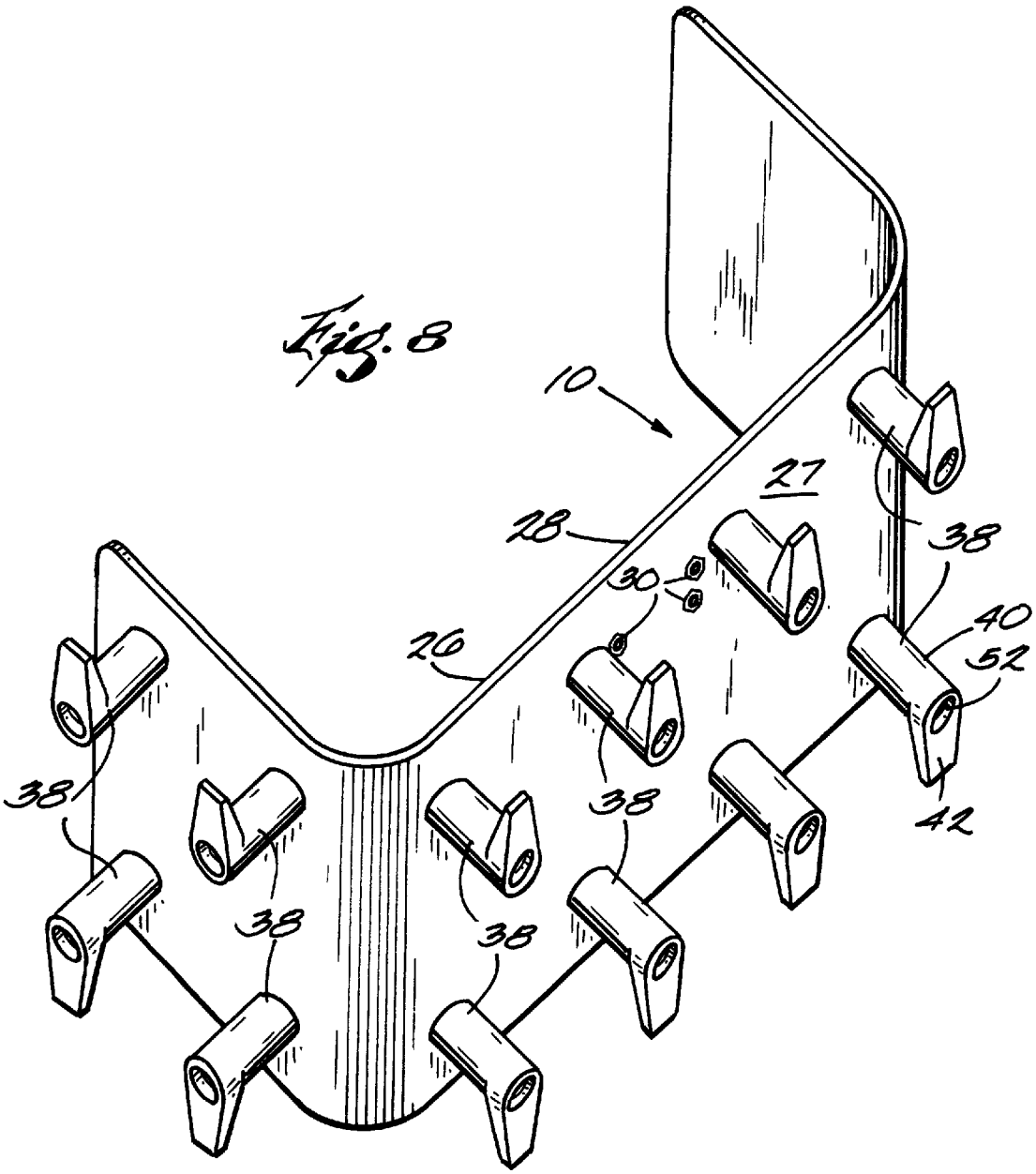
FIG. 8 is a perspective view of a second embodiment of the invention.

In other embodiments, the plate can have multiple pieces or be other than planer. For example, FIG. 8 shows a plate 26 that is bent at right angles at either end, so as to be able to accommodate additional pairs of hooks and have them located at a convenient location for the attending staff.

The preferred embodiment will be expandable in nature such that additional plates with hooks can be added on. Such additional plates will attach onto the preferred embodiment in most instances at a 90 degree angle on either or both sides duly increasing the storage capacity available.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

I claim:

1. In a medical room having a headwall system or a bracket for mounting a monitor, a medical cord storage apparatus comprising:

a) a plate having opposed top and a bottom edges and opposed left and right edges, b) means for attaching said plate to said headwall system or said bracket, c) at least one pair of opposed hooks with one of said pair adjacent said top or left edge and the other of said pair adjacent said bottom or right edge, each of said hooks including a stem having a longitudinal center line, a proximal end contacting said plate, and an opposite distal end and an arm extending at a right angle to said stem at said distal end, and, d) at least one of said pair of hooks also comprising means for locking said hook in a position in which said arm is pointed away from said other of said pair of hooks, and means for releasably allowing said arm to rotate about said stem longitudinal center line.

2. The cord storage apparatus of claim 1 wherein said means for locking said arm and said means for allowing said arm to rotate about said stem longitudinal center line comprises, a) at least one protrusion extending outwardly from the proximal end of said stem, b) at least one indentation on the surface of said plate, c) means for urging said protrusion into said indentation when the protrusion is registered with said indentation, and d) means for limiting the travel of said stem in the longitudinal direction if said stem is pulled away from said plate and rotated about its longitudinal centerline.

3. The cord storage apparatus of claim 2 wherein said means for locking said arm and for allowing said arm to rotate about said stem longitudinal center line further comprises, a) a hollow post having a first end, a second end and a length, said first end secured to said plate, with said post being internally threaded, b) a threaded screw having a head, with said head of said screw contacting said second end of said post when said screw is secured to said post, c) said stem having a first internal bore extending inwardly from the proximal end and having a length shorter than the length of said post, a second internal bore extending inwardly from the distal end having a larger diameter than said first internal bore, and a shoulder between said first and second bores, d) and a wave spring located between the underside of said screw head and said shoulder for urging said stem toward said plate.

4. The cord storage apparatus of claim 1 wherein said plate attaching means comprises a pivoting support arm.

5. The cord storage apparatus of claim 1 wherein said plate has a first front side and a second back side and said hooks are mounted on said first side and said attaching means is on said second side.

6. The cord storage apparatus of claim 5 further comprising a Velcro brand hook and loop fastener strip attached to said back side for storing a blood pressure cuff having a complementary Velcro brand hook and loop fastener.

7. For use in a medical room having a patient monitor and multiple patient monitor leads, a means for storing said leads comprising, a) a plate having opposed top and bottom and left and right edges, b) for each of the monitor leads a pair of spaced apart, opposed hooks mounted on said plate adjacent said top and bottom or left and right edges, each of said hooks comprising a stem having a first end in contact with said plate, a second opposite end and a longitudinal axis, and an arm extending radially outwardly from said stem second end, and c) for at least one of each pair of hooks, means for selectively allowing rotation of said stem and arm about said longitudinal axis, whereby each of the cords can be wrapped around said pair of hooks for storage when said arm for said one of said pair of hooks is facing away from the other of said pair, and the cord can be removed from storage by rotating said at least one hook so said arm faces toward the other of said pair.

8. The medical room monitor lead storage means of claim 7 wherein said plate has a first front side, a second back side and said hooks are attached to said front side and a plate mounting bracket is attached to said second back side.

9. The medical room monitor lead storage means of claim 8, further comprising a means for releasably locking said stem of said one of said pair of hooks for discontinuation of rotation about said longitudinal axis.

10. The medical room monitor lead storage means of claim 9 wherein said locking means comprises at least one protrusion extending from the proximal end of said stem and at least one indentation on the first front surface of said plate.

11. The medical room monitor lead storage system of claim 10 wherein said means for selectively allowing rotation of said stem about said longitudinal axis comprises a hollow post having a first end, a second end and a length, with said first end secured to said plate, said post being internally threaded, a threaded screw having a head, with said head of said screw contacting said second end of said post when secured to said post, said stem having a first internal bore extending from said proximal end and having a length shorter than the length of said post, a second internal bore extending from said distal end having a larger diameter than said first internal bore and a shoulder between said first and second bores, and a wave spring located between said screw head and said shoulder for urging said stem toward said plate.

* * * * *